US007173205B2

(12) United States Patent
Yamamoto

(10) Patent No.: US 7,173,205 B2
(45) Date of Patent: Feb. 6, 2007

(54) ELECTRONIC DEVICE WITH MANUAL OPERATION BUTTON

(75) Inventor: Masateru Yamamoto, Echizen (JP)

(73) Assignee: Orion Electric Co., Ltd., Fukui (JP)

( * ) Notice: Subject to any disclaimer, the term of this patent is extended or adjusted under 35 U.S.C. 154(b) by 0 days.

(21) Appl. No.: 11/378,286

(22) Filed: Mar. 20, 2006

(65) Prior Publication Data

US 2006/0219543 A1 Oct. 5, 2006

(30) Foreign Application Priority Data

Mar. 30, 2005 (JP) ..... 2005-098752

(51) Int. Cl.
*H01H 13/70* (2006.01)

(52) U.S. Cl. ..... 200/343; 200/344; 200/345; 200/520

(58) Field of Classification Search ..... 200/343
See application file for complete search history.

(56) References Cited

U.S. PATENT DOCUMENTS 5,623,393 A * 4/1997 Yau ..... 361/682
6,051,799 A * 4/2000 Fuhrmann ..... 200/331
6,570,111 B2 * 5/2003 Nakagawa et al. ..... 200/343
6,914,206 B2 * 7/2005 Mukougawa ..... 200/556
7,002,086 B2 * 2/2006 Fuji ..... 200/305

FOREIGN PATENT DOCUMENTS

JP 2005-50750 2/2005

* cited by examiner

*Primary Examiner*—Elvin Enad
*Assistant Examiner*—Lheiren Mae A. Anglo
(74) *Attorney, Agent, or Firm*—Westerman, Hattori, Daniels & Adrian, LLP.

(57) ABSTRACT

The invention provides a manual operation button having a large operable area. A manual operation button is composed of a manual operation plane, a holder for assembling the manual operation plane and a stopper for fixing the holder to a casing. The casing has a mounting hole having substantially the same size and shape as the manual operation plane, so that when the manual operation plane is assembled to the mounting hole, the manual operation plane forms a substantially continuous flat plane with the casing. The holder includes a substantially L-shaped mounting portion for mounting to the casing, a flat plate-like mounting plane for mounting the manual operation plane, and a hinge portion connecting the mounting portion and the mounting plane. The whole width of the hinge portion is disposed within the outer projection plane of the manual operation plane.

5 Claims, 16 Drawing Sheets

(a)

(b)

(b)

(a)

ELECTRONIC DEVICE WITH MANUAL OPERATION BUTTON

The present application is based on and claims priority of Japanese patent application No. 2005-098752 filed on Mar. 30, 2005, the entire contents of which are hereby incorporated by reference.

BACKGROUND OF THE INVENTION

1. Field of the Invention

The present invention relates to a manual operation button of an electronic device, and more specifically, relates to a power button disposed on a front face of a television receiver.

2. Description of the Related Art

Heretofore, an arrangement of the type disclosed in Japanese patent application No. 2005-50750 (patent document 1) utilizing a bendable thin hinge has been adopted in manual operation buttons of electronic devices, since it exerts the required functions via a simple assembly operation and without using metal components such as spindles and springs.

One exemplary structure of such prior art manual operation button adopting the above hinge arrangement and used in electronic devices such as the television receiver will be described with reference to FIG. 14. The electronic device includes a casing 100, a switch 101 fixed to the inner side of the casing 100, and a manual operation button 102 for operating the switch 101 by the manual operation of a user. The casing 100 has a mounting hole 103 for exposing a portion of the manual operation button 102 to the exterior of the casing 100. The manual operation button 102 comprises a manual operation plane 104 exposed to the exterior of the casing 100 so as to be directly touched and pressed by the user, a switch pressing portion 105 extended toward the rear direction of the manual operation plane 104, a mounting portion 106 for mounting onto the casing 100, and a hinge portion 107 formed as a bendable thin wall connecting the manual operation plane 104 and the mounting portion 106. Here, the manual operation button 102 is formed via integral molding. According to the manual operation button 102 adopting such hinge structure, when the user presses the manual operation plane 104 in the direction of the arrow as illustrated in FIG. 15, the switch pressing portion 105 pivots around the hinge portion 107 and moves to operate the switch 101.

However, since according to patent document 1 and the manual operation button 102 having the prior art structure, the hinge portion 107 is out of range of the outer projection plane of the manual operation plane 104, it is difficult to increase the size of the manual operation plane 104, or in other words, it is difficult to enlarge the operable region. Here, the term "outer projection plane of the manual operation plane" refers to the outer shape of the manual operation plane 104 subjected to projection from the front direction, and the term "operable region" refers to the region in which the user can operate the switch 101 on the front face of the manual operation plane 104.

Furthermore, since the manual operation plane 104 requiring a high molding accuracy to be provided with characters and patterns is integrally molded with other components that do not require such high molding accuracy as the manual operation plane 104, there is a drawback in that the whole manual operation button 102 must be formed with high molding accuracy, by which the molding costs are increased.

Moreover, since the manual operation button includes the hinge portion 107, there is a drawback in that if the manual operation plane 104 is pressed in particular ways, such as in the direction of the arrow of FIG. 16, the upper portion of the manual operation button 102 protruded outward from the front face of the casing 100.

SUMMARY OF THE INVENTION

In consideration of the prior art problems mentioned above, the present invention aims at providing an electronic device with a manual operation button capable of having a manual operation plane with a wide operable region, cutting down the molding costs of the manual operation button, and preventing the manual operation button from protruding from the casing.

A first aspect of the present invention provides an electronic device with a manual operation button having a casing, a switch fixed to an inner side of the casing, and a manual operation button for operating the switch via the manual operation of a user, wherein the casing has a mounting hole for exposing a portion of the manual operation button to the exterior of the casing, and wherein the manual operation button comprises a manual operation plane exposed to an exterior through the mounting hole formed to the casing which is directly pressed by the user; a holder disposed at the rear portion of the manual operation plane; and a switch pressing portion extended rearward from the holder; and wherein the holder comprises a mounting portion used for mounting to the casing, and a hinge portion having a bendable thin wall connecting the holder and the mounting portion, the whole or a portion of the hinge portion disposed within an outer projection plane of the manual operation plane.

According to the arrangement of aspect 1, by mounting the manual operation button and the holder to the casing, the manual operation plane is inserted to the mounting hole on the casing with the manual operation plane and the casing connecting flatly, so that when the manual operation plane is pressed, the hinge portion of the holder to which the manual operation plane is assembled is bent so as to turn the switch on/off via the switch pressing portion. Further, since the whole or a portion of the hinge portion is disposed within the outer projection plane of the manual operation plane, it is possible to ensure a large manual operation plane, and thus it is possible to enlarge the operable region.

A second aspect of the present invention relates to the electronic device with a manual operation button according to the first aspect, further comprising a stopper means capable of coming into contact with the manual operation button.

According to the arrangement of aspect 2, the stopper capable of coming into contact with the manual operation button enables to limit the force in which the switch pressing portion extended rearward from the holder presses the switch fixed to the inner side of the casing when the user presses the manual operation plane and the hinge portion of the holder is bent. Therefore, the switch will not be pressed with excessive force by the switch pressing portion.

A third aspect of the present invention relates to the electronic device with a manual operation button according to aspects 1 or 2, further comprising a stopper means provided on the manual operation button to prevent the manual operation button from protruding from the casing.

According to the arrangement of aspect 3, a stopper means is provided to prevent the operation button from protruding outward from the front face of the casing, which may occur if the manual operation plane is pressed in specific ways, by the stopper means coming into contact with the casing and restricting projection of the manual operation plane.

A fourth aspect of the present invention relates to the electronic device with a manual operation button according to anyone of aspects 1 through 3, wherein the hinge portion is disposed at an end portion of the outer projection plane of the manual operation plane.

According to the arrangement of aspect 4, since all or a portion of the hinge portion formed to the holder is included in the outer projection plane of the manual operation plane, and since the hinge portion is disposed at an end of the outer projection plane of the manual operation plane, the operable region of the manual operation plane can be enlarged.

A fifth aspect of the present invention relates to a television receiver with a manual operation button comprising a casing, a substrate fixed to an inner side of the casing, a switch fixed to the substrate, and a manual operation button for operating the switch via manual operation of a user; wherein the casing includes a mounting hole through which a portion of the manual operation button is exposed to an exterior of the casing, a protruded portion for mounting the manual operation button, and a cover capable of being opened and closed by revolving around a spindle as a supporting point, having in the inner side of the cover a manual operation switch for adjusting volume and switching channels and a connecting terminal for connecting a cable for inputting/outputting signals to/from another electronic device; the manual operation button includes a manual operation plane exposed to the exterior of the casing to be pressed directly by the user, a holder disposed on a rear side of the manual operation plane, a switch pressing portion extended rearward from the holder, a mounting portion having a fitting hole that fits with the projection, and a hinge portion having a bendable thin wall connecting the holder and the mounting portion; wherein a whole area of the hinge portion is disposed within an outer projection plane of the manual operation plane, the hinge portion also having a stopper means disposed at a lower end portion of the outer projection plane and capable of coming into contact with the manual operation button; the holder, the switch pressing portion, the mounting portion and the hinge portion being formed integrally; the manual operation plane and the cover being disposed horizontally on a front face of the casing; and the height of the manual operation plane being substantially the same as that of the cover.

According to the arrangement of aspect 5, the television receiver can have a large manual operation plane and thus a large operable region, the enlarged manual operation plane contributing not only to improve the operability of the receiver but also to improve the exterior design thereof.

DETAILED DESCRIPTION OF THE PREFERRED EMBODIMENTS

Now, the preferred embodiments for carrying out the present invention will be described with reference to the drawings.

Figure 1:
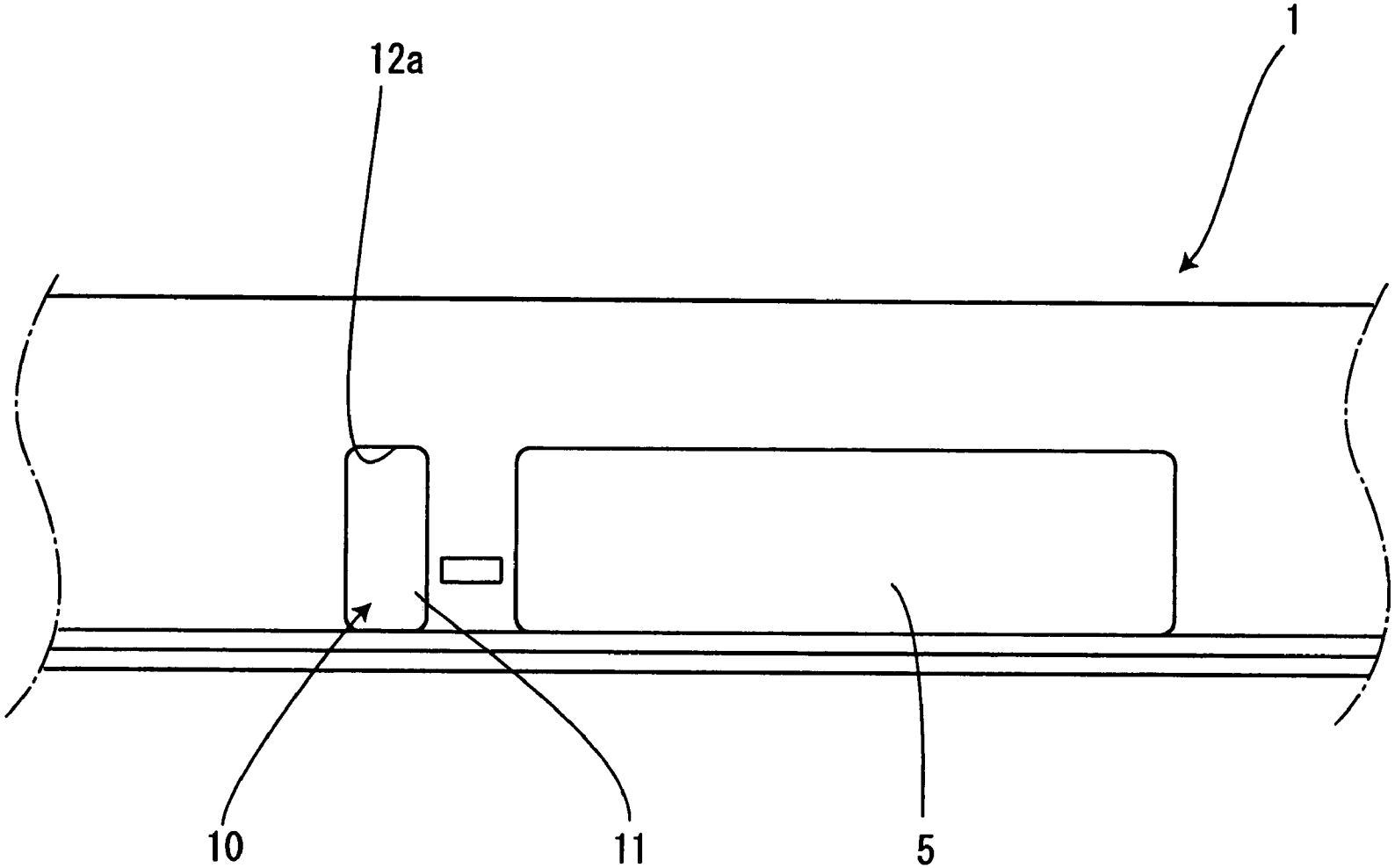
FIG. 1 is a front view of an electronic device with its cover closed according to one embodiment of the present invention.
Figure 2:
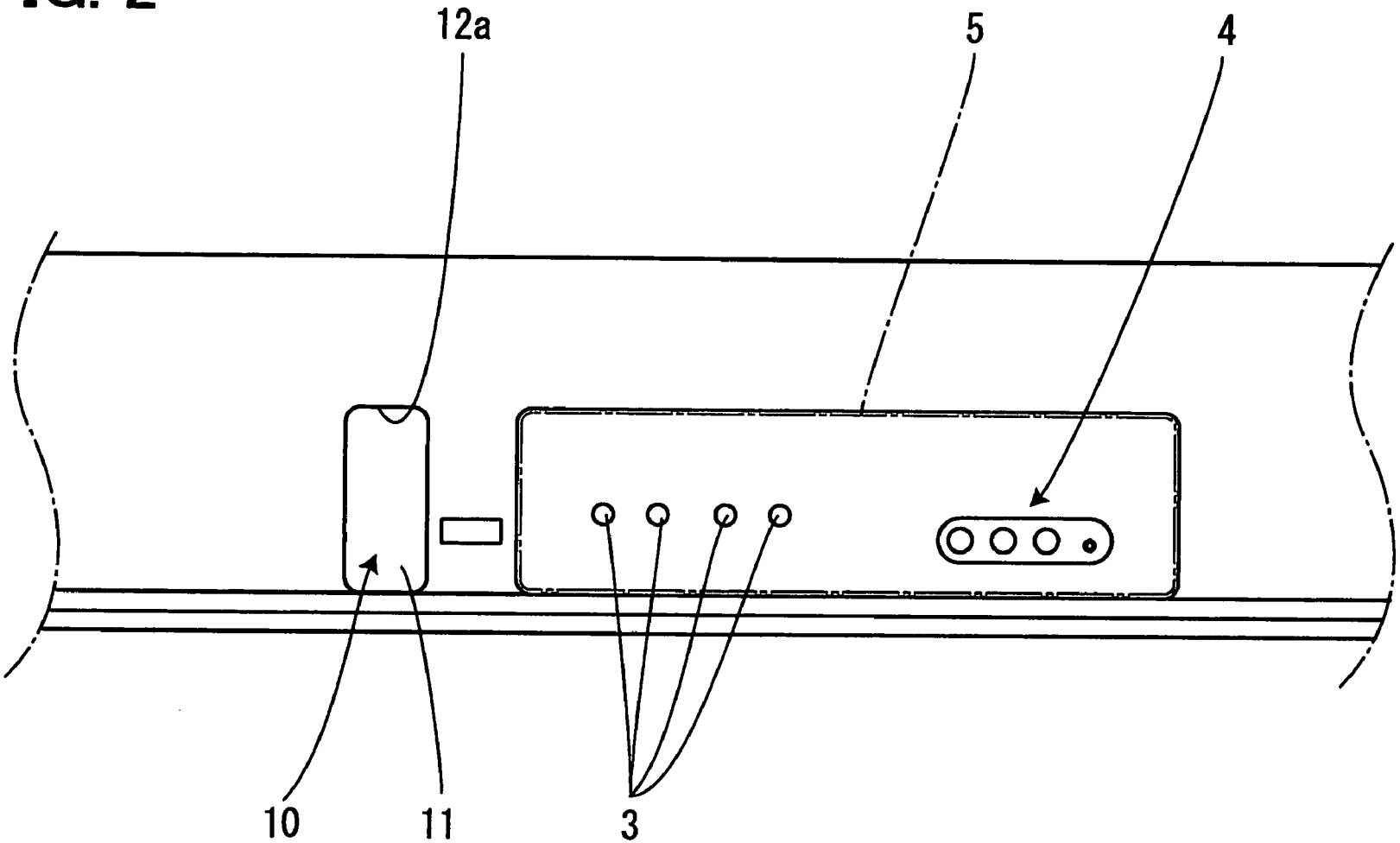
FIG. 2 is a front view of an electronic device with its cover opened according to the same.
Figure 3:
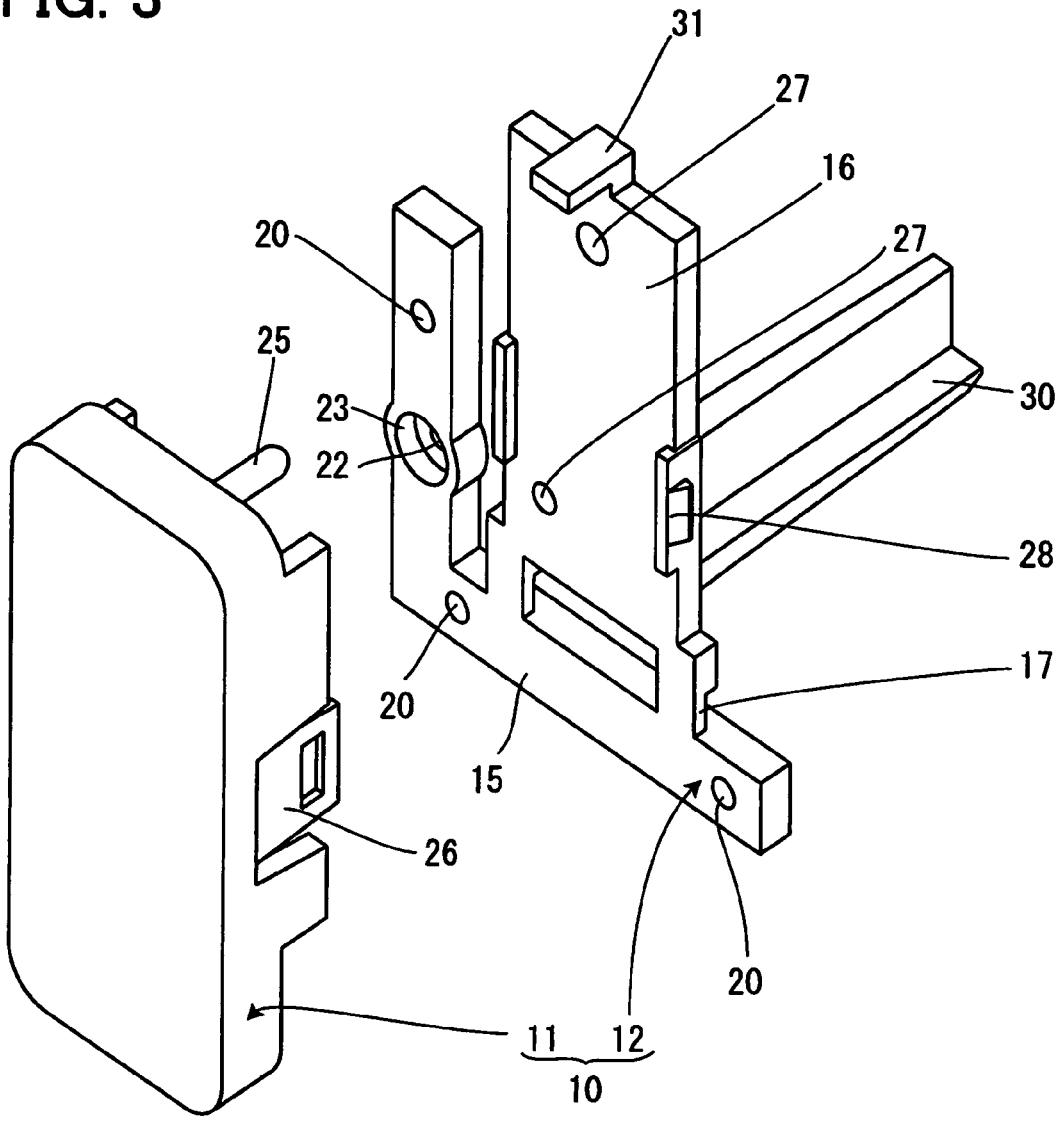
FIG. 3 is an exploded perspective view of a manual operation plane and a holder according to the same.
Figure 4:
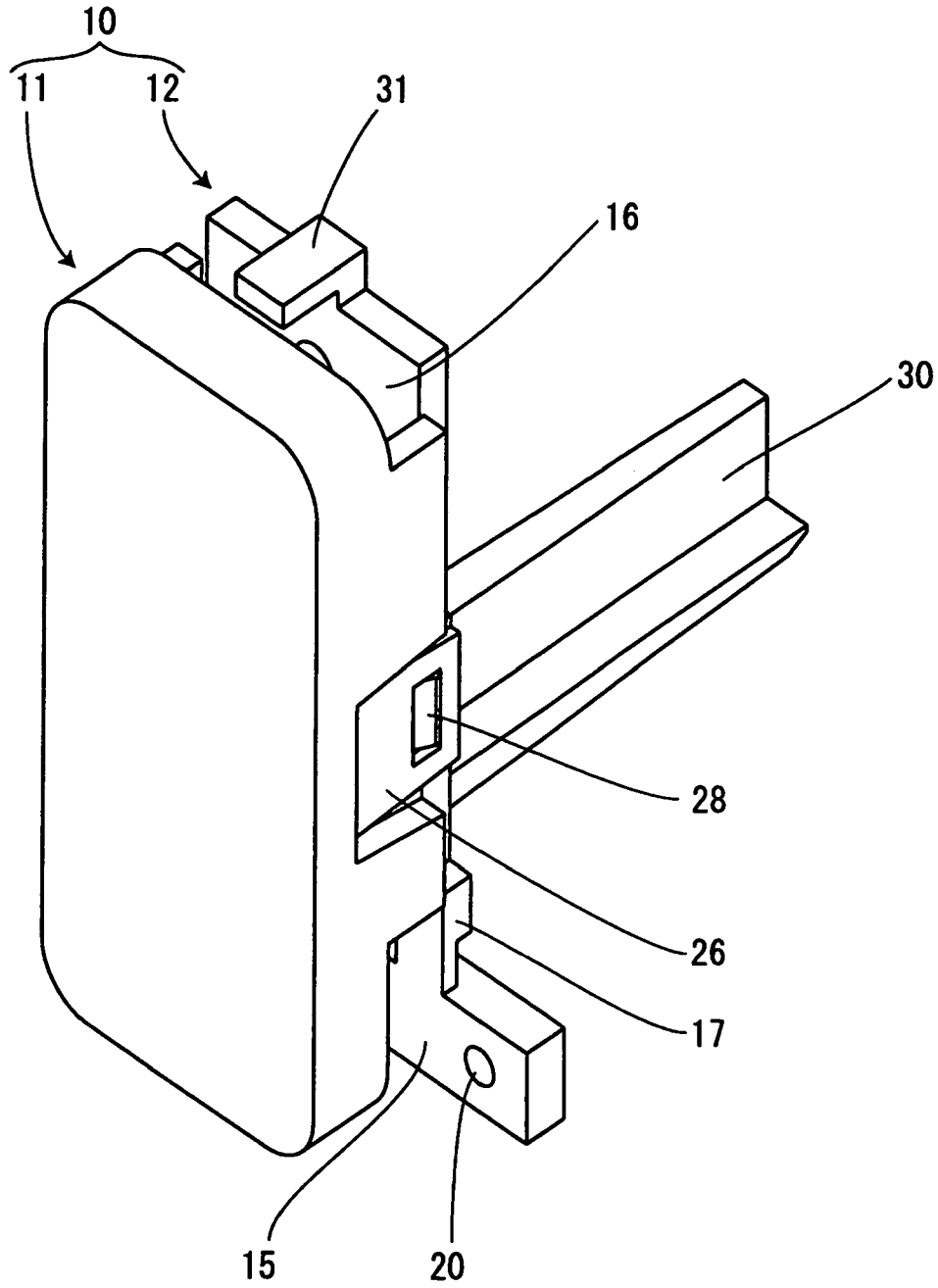
FIG. 4 is a perspective view of a manual operation button according to the same.
Figure 5:
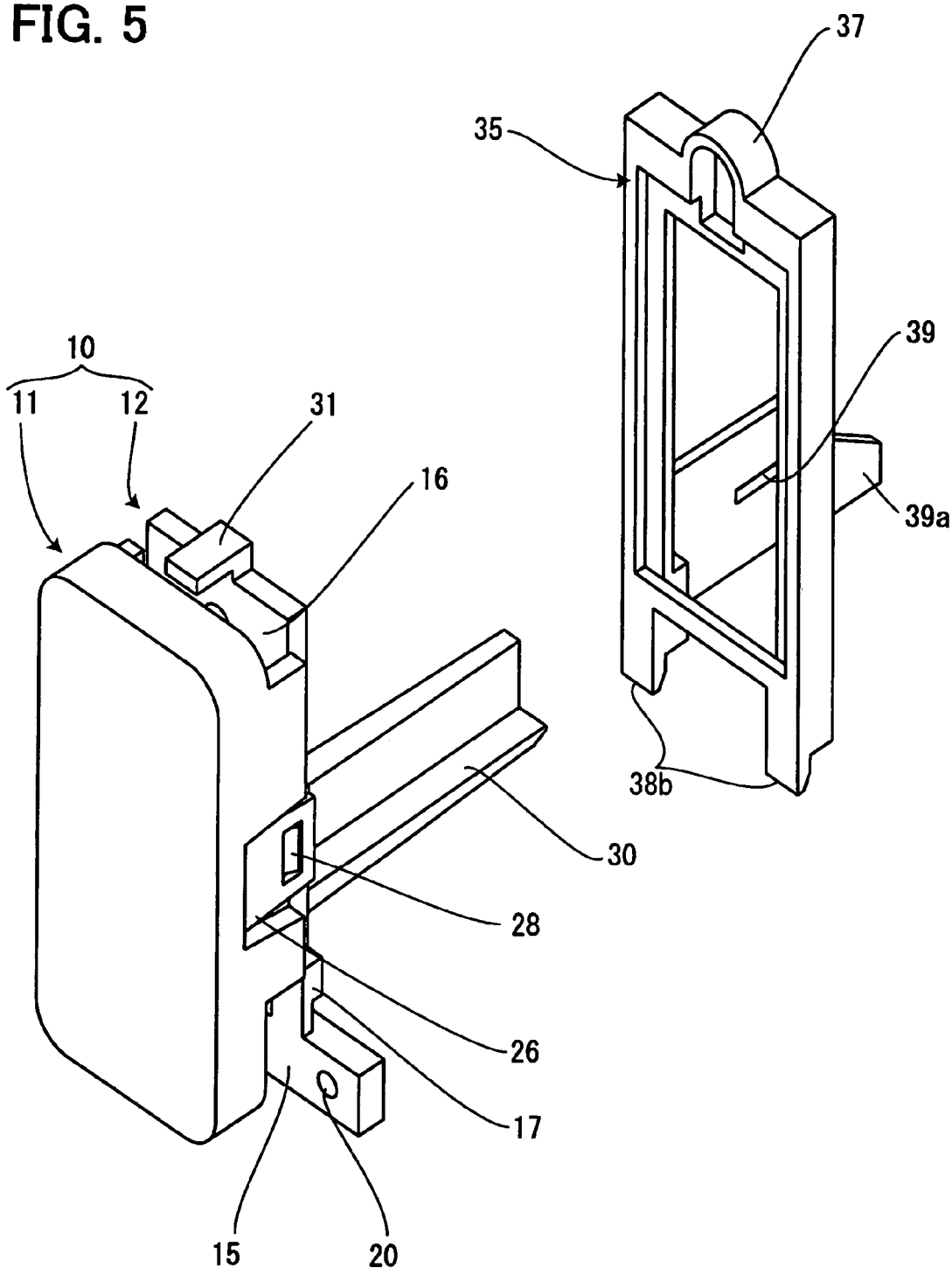
FIG. 5 is an exploded perspective view of the manual operation button and a stopper according to the same.
Figure 6:
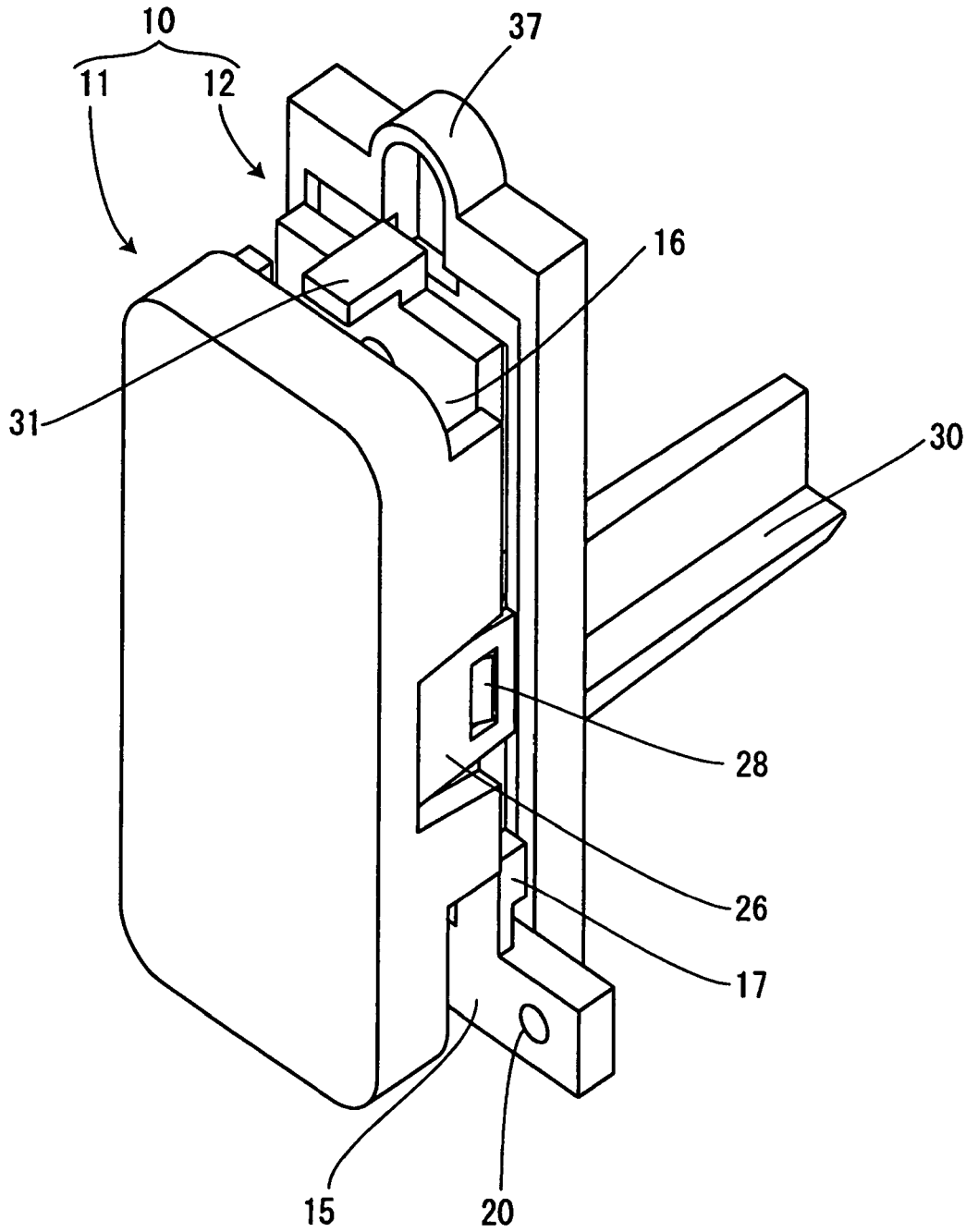
FIG. 6 is a perspective view showing the stopper arranged at the rear portion of the manual operation button.
Figure 7:
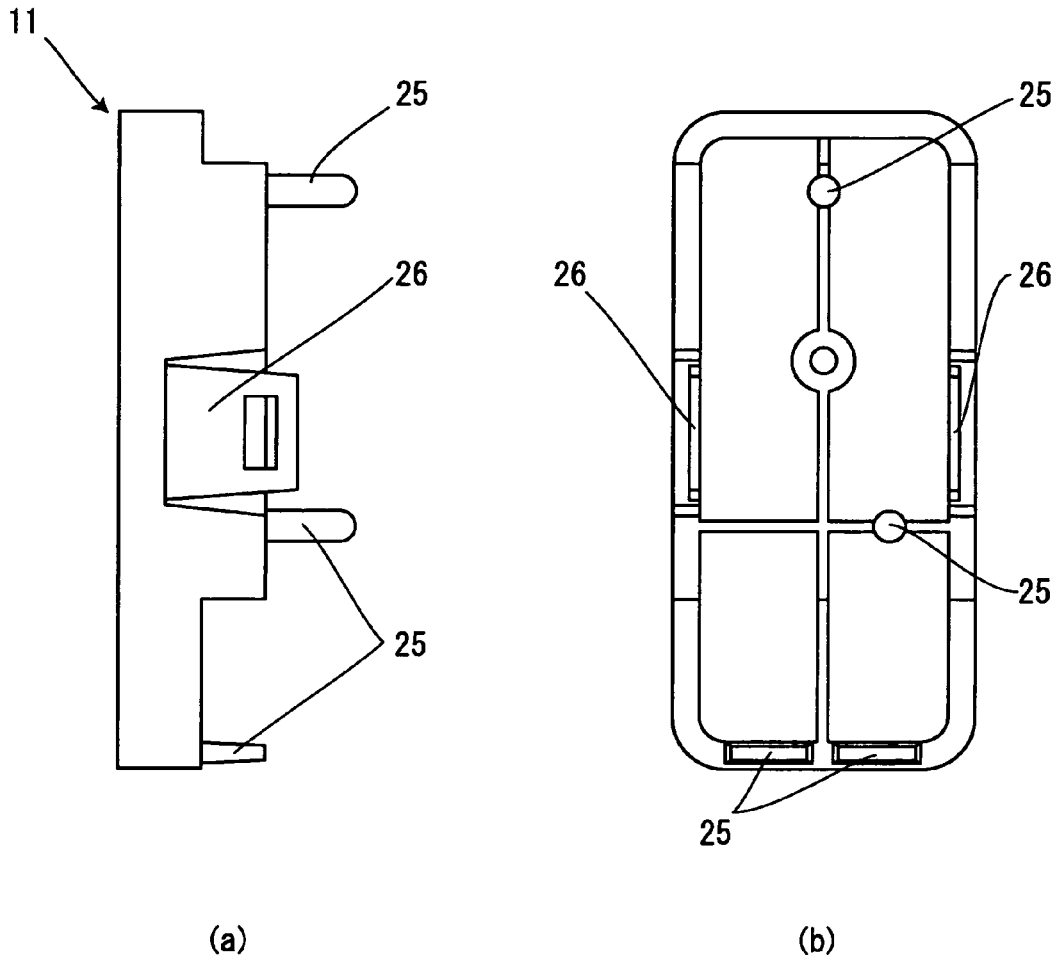
FIG. 7 shows the manual operation plane according to the same, wherein FIG. 7(*a*) is a side view and FIG. 7(*b*) is a rear view thereof.
Figure 8:
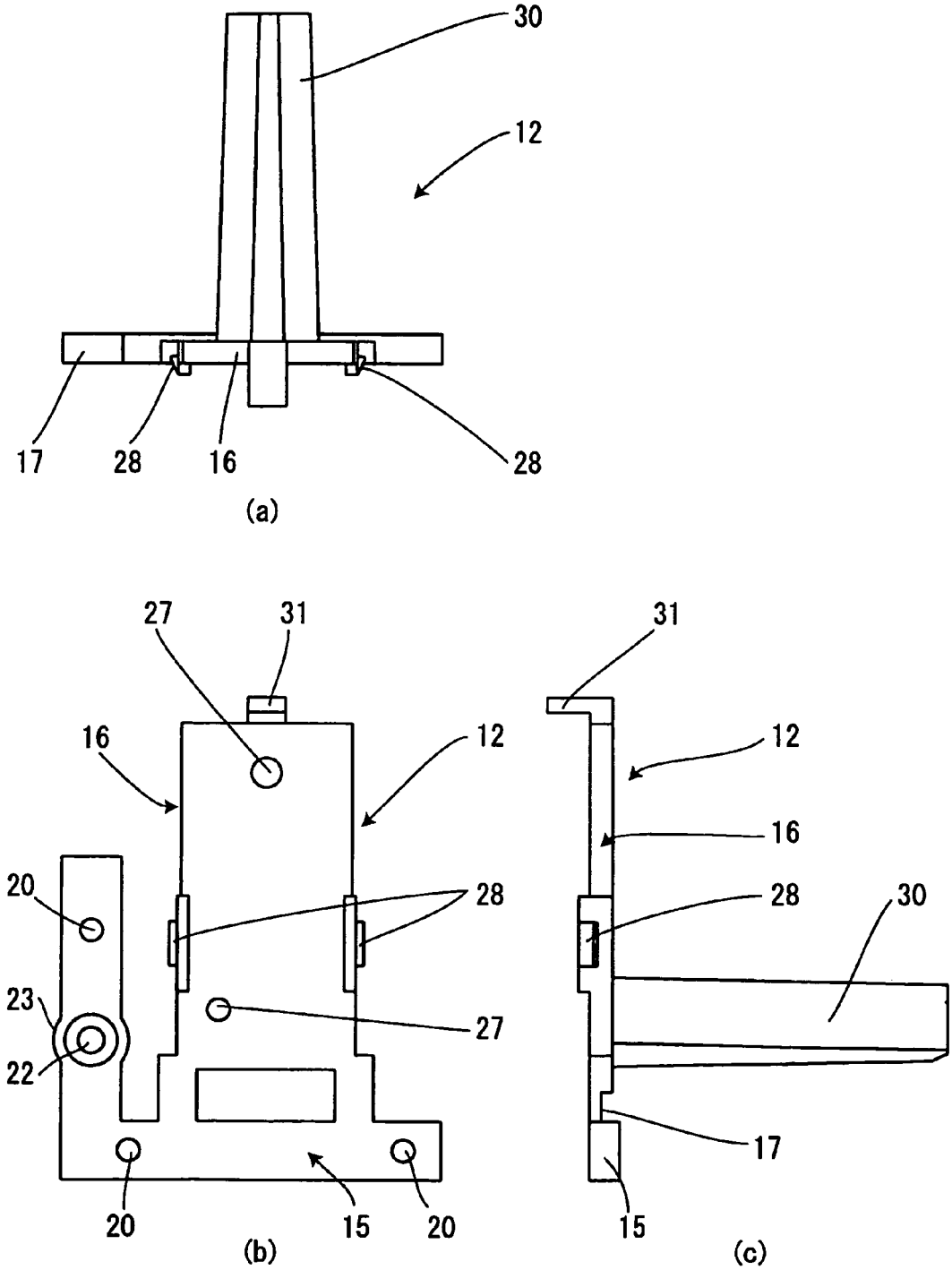
FIG. 8 shows the holder according to the same, wherein FIG. 8(*a*) is a plan view, FIG. 8(*b*) is a front view and FIG. 8(*c*) is a side view thereof.
Figure 9:
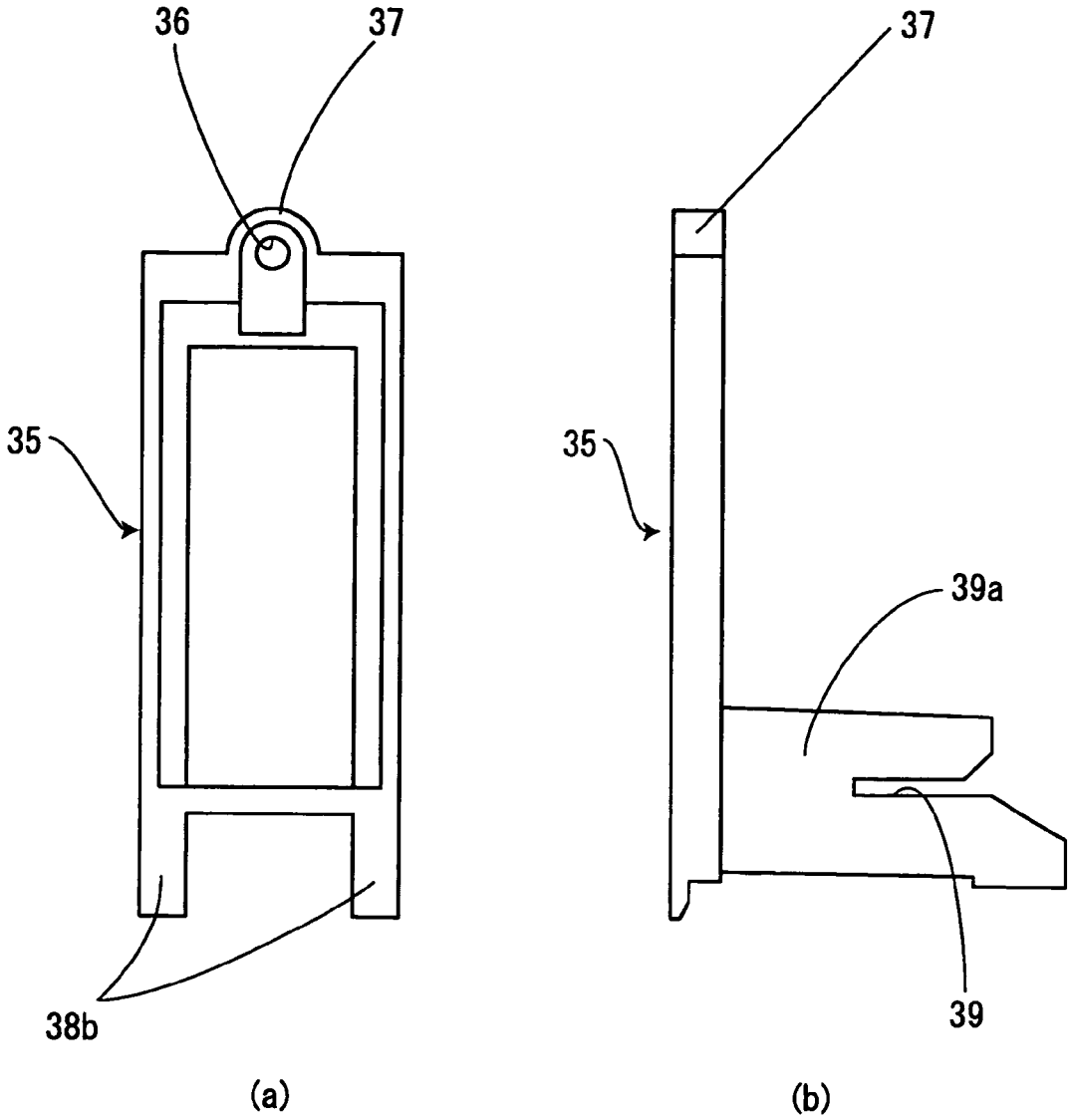
FIG. 9 shows the stopper according to the same, wherein FIG. 9(*a*) is a front view and FIG. 9(*b*) is a side view thereof.
Figure 10:
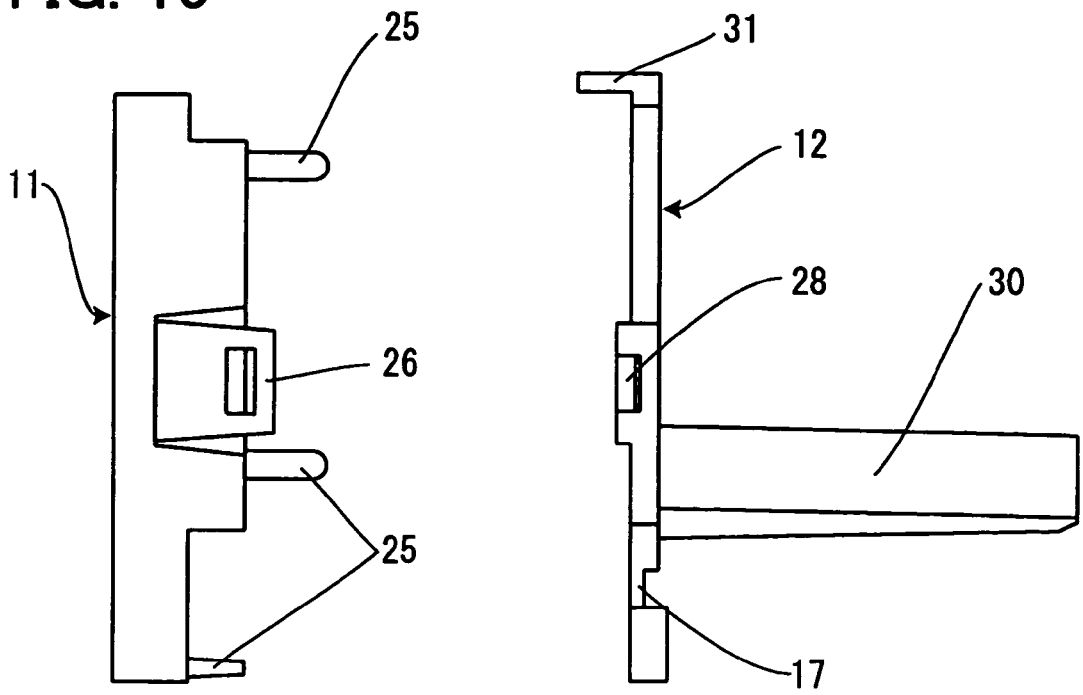
FIG. 10 shows the assembled state of the manual operation plane and the holder according to the same, wherein FIG. 10(*a*) is an exploded side view and FIG. 10(*b*) is a side view of the assembled state.
Figure 10:
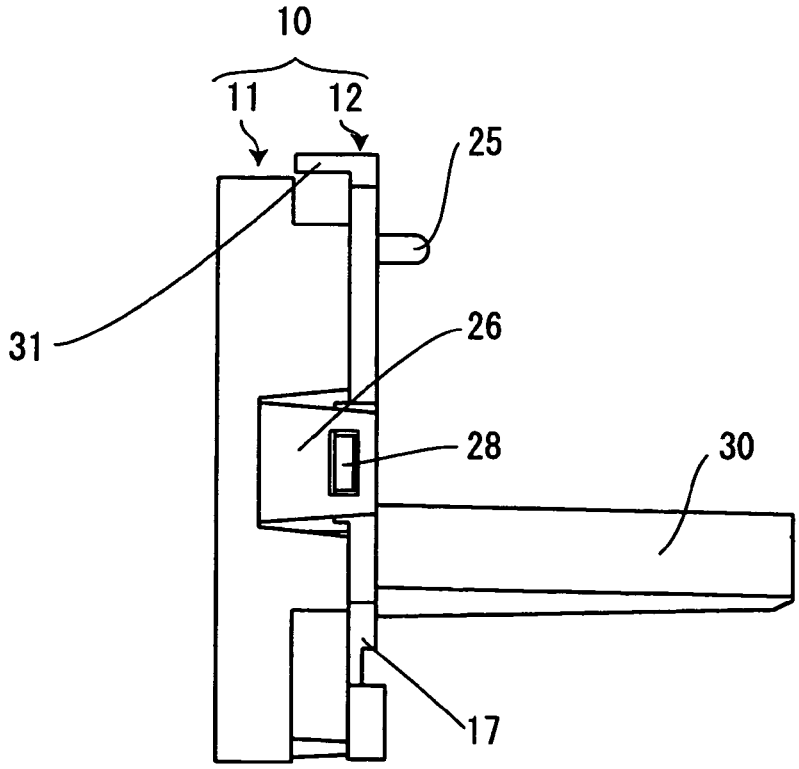
Figure 11:
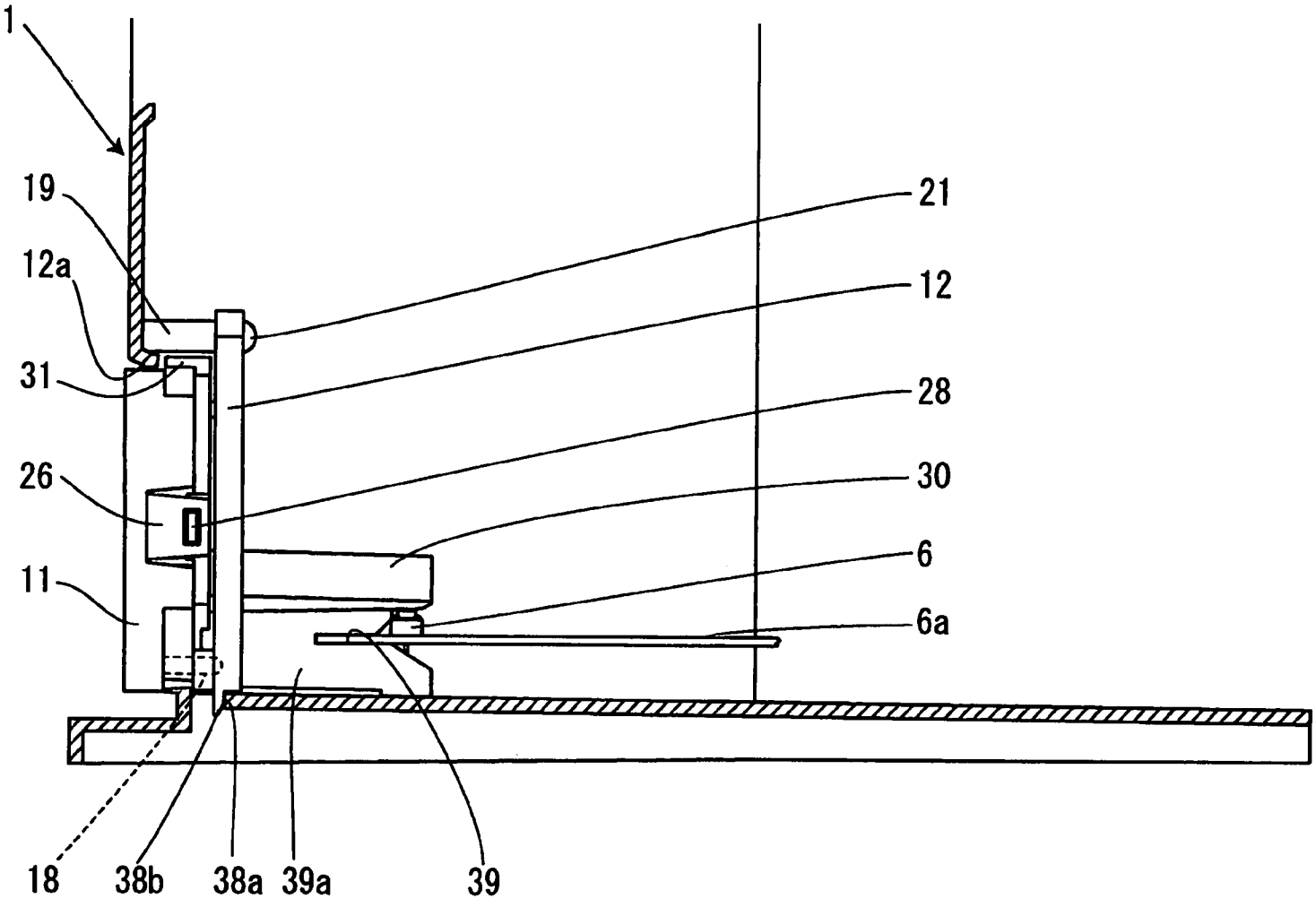
FIG. 11 is a cross-sectional view showing the assembled state of the manual operation button according to the same.

FIG. 1 is a front view of an electronic device, and according to the present embodiment, the electronic device to which the invention is applied is a television receiver. On the front face of a casing 1 of the television receiver are arranged a plurality of manual operation switches 3 for manually adjusting the volume and switching channels and connecting terminals 4 for connecting cables enabling signals to be input from or output to other electronic devices. These manual operation switches 3 and connecting terminals 4 are covered by a cover 5 capable of being opened and closed via a spindle not shown as supporting point. Adjacent to the cover 5 is arranged a manual operation button 10 for manually operating a switch 6 to turn the main power on and off.

The manual operation button 10 is composed of a manual operation plane 11, a holder 12 to which the manual operation plane 11 is assembled, and a stopper 35 for fixing the holder 12 to the casing 1, and these components are integrally molded from resin material. The casing 1 to which the manual operation button 10 is mounted has a mounting hole 12*a* with a size and shape substantially the same as those of the manual operation plane 11, so that when the manual operation plane 11 is assembled to the mounting hole 12*a*, the manual operation plane 11 substantially constitutes a flat continuous plane with the casing 1. Moreover, in order for the manual operation plane 11 to have an aligned height with the cover 5 covering the manual operation switches 3 and the connecting terminals 4, the manual operation plane 11 of the present embodiment is approximately 30 mm in width and 65 mm in height, which is larger than the size of a typical manual operation plane.

The holder 12 is composed of a substantially L-shaped mounting portion 15 used for mounting the holder to the casing 1, and a substantially planar mounting plane 16 for mounting the manual operation plane 11, wherein the mounting portion 15 and the mounting plane 16 are connected via a hinge portion 17 having a bendable thin wall. The mounting portion 15 has aligning holes 20 and a cylindrical portion 23 with a screw through hole 22 corresponding to aligning pins 18 and a mounting boss portion (not shown) formed to the casing 1. On the other hand, the mounting plane 16 has aligning holes 27 and engagement claws 28 corresponding to aligning pins 25 and hooks 26 formed on the manual operation plane 11. Moreover, on the rear side of the mounting plane 16 is provided a switch pressing portion 30 for pressing the switch 6 extending in the rearward direction, and at substantially the center of the upper rim of the mounting plane 16 is provided a protrusion-preventing stopper 31 projected in a substantially L-shape that contacts the inner surface of the casing 1 for preventing the manual operation plane 11 from protruding outward from the casing 1. The whole width of the hinge portion 17 is included in the outer projection plane of the manual operation plane 11.

Reference 35 denotes a stopper that comes into contact with the holder 12 and prevents the switch from being pressed excessively by the switch pressing portion 30. The stopper 35 has a frame-like overall shape and includes a cylindrical portion 37 with a through hole 36 for a screw 21 corresponding to a mounting boss portion 19 formed to the inner side of the casing 1 with a slight distance from the rear surface of the holder 12, and on the lower portion of the stopper 35 are provided engagement projections 38*b* that fit to the engagement holes 38*a* formed to the casing 1. Further, on the rear surface of the stopper 35 is provided a rib 39*a* projected so as to support a substrate 6*a* on which the switch 6 is mounted, and on the rib 39*a* is formed a notched groove 39 for inserting the substrate 6*a*.

As illustrated in FIGS. 3 through 11, according to the present embodiment having the structure described above, at first, the aligning pins 25 are inserted to aligning holes 27 formed to the mounting plane 16 of the holder 12, and the hook 26 on the manual operation plane 11 is engaged to the engagement claw 28 so as to integrate the manual operation plane 11 and the holder 12 in a unit. Thereafter, the aligning holes 20 and the cylindrical portion 23 of the holder 12 are inserted to the aligning pins 18 and a mounting boss portion (not shown) formed to the casing 1, and a screw is engaged to the mounting boss portion through the through hole 22 of the cylindrical portion 23 so as to fix the manual operation plane 11 and the holder 12 formed as a unit to the casing 1. Thereafter, the engagement projections 38*b* of the stopper 35 are engaged with the engagement holes 38*a* formed to the casing 1, and at the same time, the cylindrical portion 37 formed to the stopper 35 is fit to the mounting boss portion 19 and a screw 21 is engaged to the mounting boss portion 19 through the through hole 36 of the cylindrical portion 37 so as to fix the stopper 35 to the casing 1. Thereby, the manual operation button 10 is mounted to the casing 1. Thereafter, the substrate 6*a* mounting the switch 6 is inserted to the notched groove 39 of the rib 39*a* formed to the rear surface of the stopper 35 so as to fix the substrate 6*a* including the switch 6 to the casing 1.

Thus, by mounting the manual operation button 10 and the holder 12 on the casing 1, the manual operation plane 11 is fit to the mounting hole 12*a* of the casing 1, by which the manual operation plane 11 and the casing 1 are arranged flat and continuously, and when the manual operation plane 11 is pressed, the hinge portion 17 of the holder 12 to which the manual operation plane 11 is assembled is bent and the switch pressing portion 30 turns the switch 6 on or off. At this time, the manual operation button 10 comes into contact with the stopper 35 so as to prevent the switch 6 from being pressed excessively by the switch pressing portion 30. Furthermore, the protrusion-preventing stopper 31 formed on the upper rim of the mounting plane 16 comes into contact with the inner surface of the casing 1 and prevents the manual operation plane 11 from protruding outward from the casing 1. Moreover, since the whole width of the hinge portion 17 is disposed within the outer projection plane of the manual operation plane 11, it becomes possible to adopt a larger manual operation plane 11 compared to the prior art, and also to increase the operable region thereof compared to the prior art. In addition, since it is possible to separately form the manual operation plane 11 that is exposed directly to the exterior and the holder 12 for assembling the manual operation plane 11 to the casing 1, the front face of the casing 1 and the manual operation plane 11 assembled on the front face of the casing 1 which are directly visible to the user and are often subjected to scratch-brush finishing, graining, fair lining and other various decorative processing and required to have high forming accuracy can be formed separately from the other components such as the holder 12 and the stopper 35 that do not require such a high forming accuracy as the manual operation plane 11, so the costs for forming the manual operation button 10 can be cut down compared to the case where the whole body of the manual operation button 10 is formed integrally. Further, the whole area of the hinge portion 17 is disposed within the outer projection plane of the manual operation plane 11 and the manual operation button 10 moves back and forth in a pivoting motion on the hinge portion 17, but the stopper 35 prevents the switch 6 from being pressed excessively. On the other hand, the frontward movement of the manual operation button 10 is restricted by the protrusion-preventing stopper 31 formed to the holder 12, by which the manual operation plane 11 is prevented from protruding outward from the casing 1. Moreover, by arranging the manual operation button 10 on the casing 1 so that the heights of the manual operation plane 11 and the cover 5 covering the manual operation switches 3 and connecting terminals 4 are the same, the appearance of the device is integrated, which contributes to improving the exterior design of the device as well as enhancing the operability by the large-sized manual operation plane 11.

Figure 12:
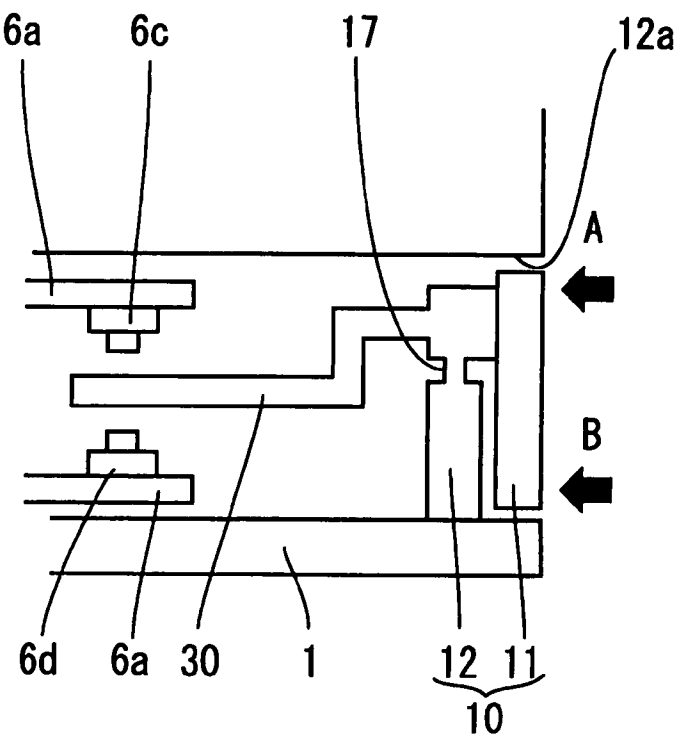
FIG. 12 shows a modified example of the present invention, wherein FIG. 12(*a*) is a side view of an example having a hinge portion formed the upper area of the manual operation plane and FIG. 12 (*b*) is a side view of an example having the hinge portion formed near the center of the manual operation plane.
Figure 12:
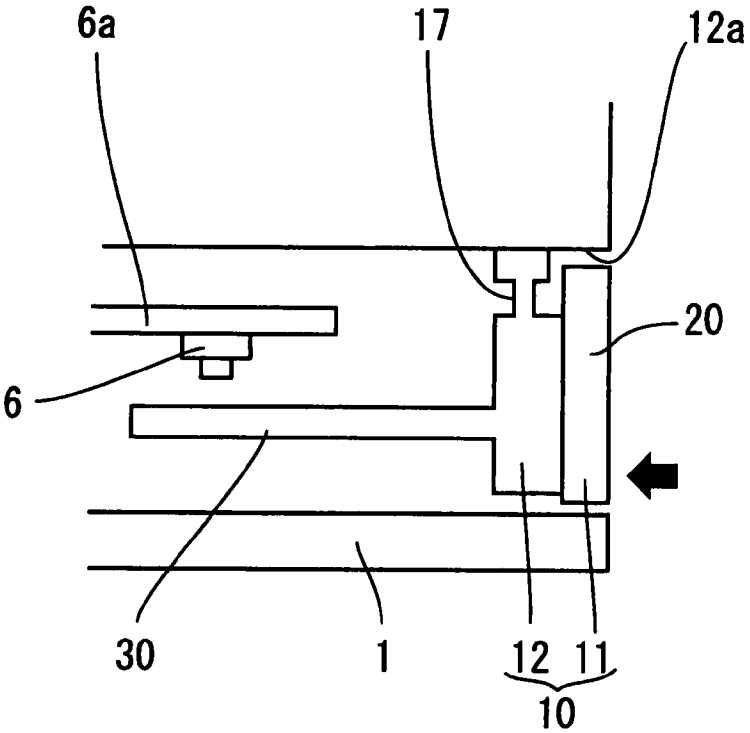
Figure 13:
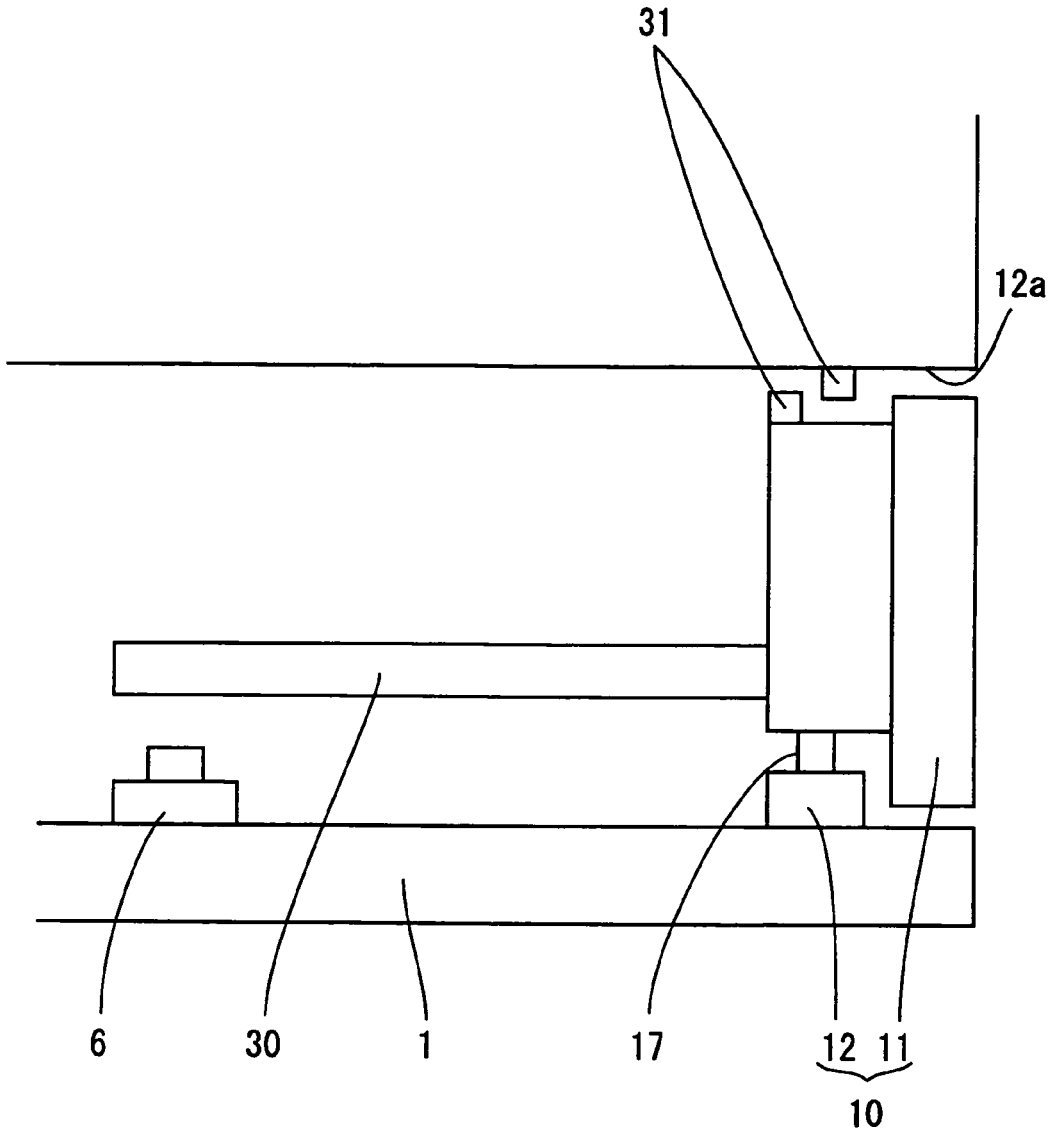
FIG. 13 is a side view showing a modified example of the present invention in which the stopper is modified.
Figure 14:
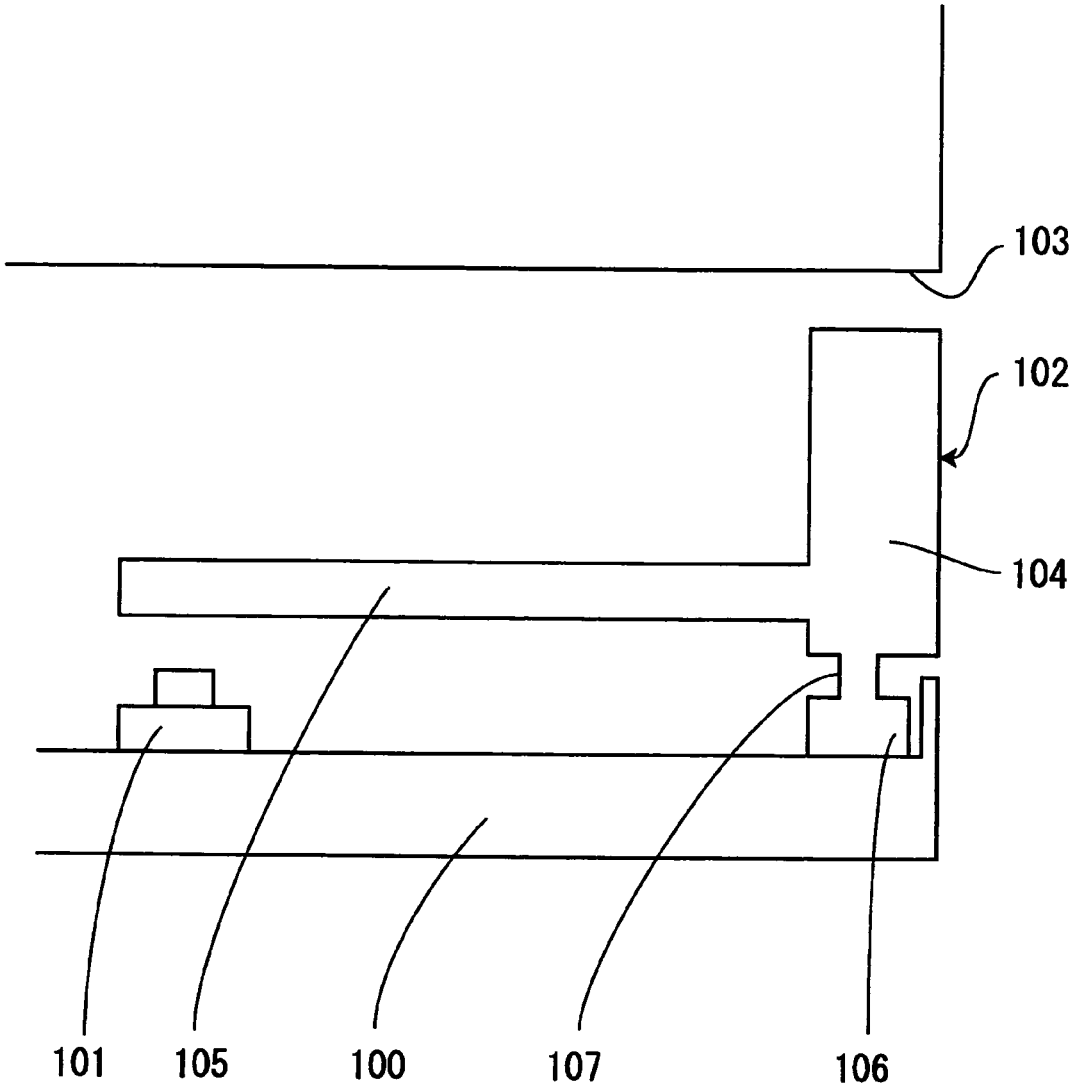
FIG. 14 is a side view of a manual operation button according to the prior art.
Figure 15:
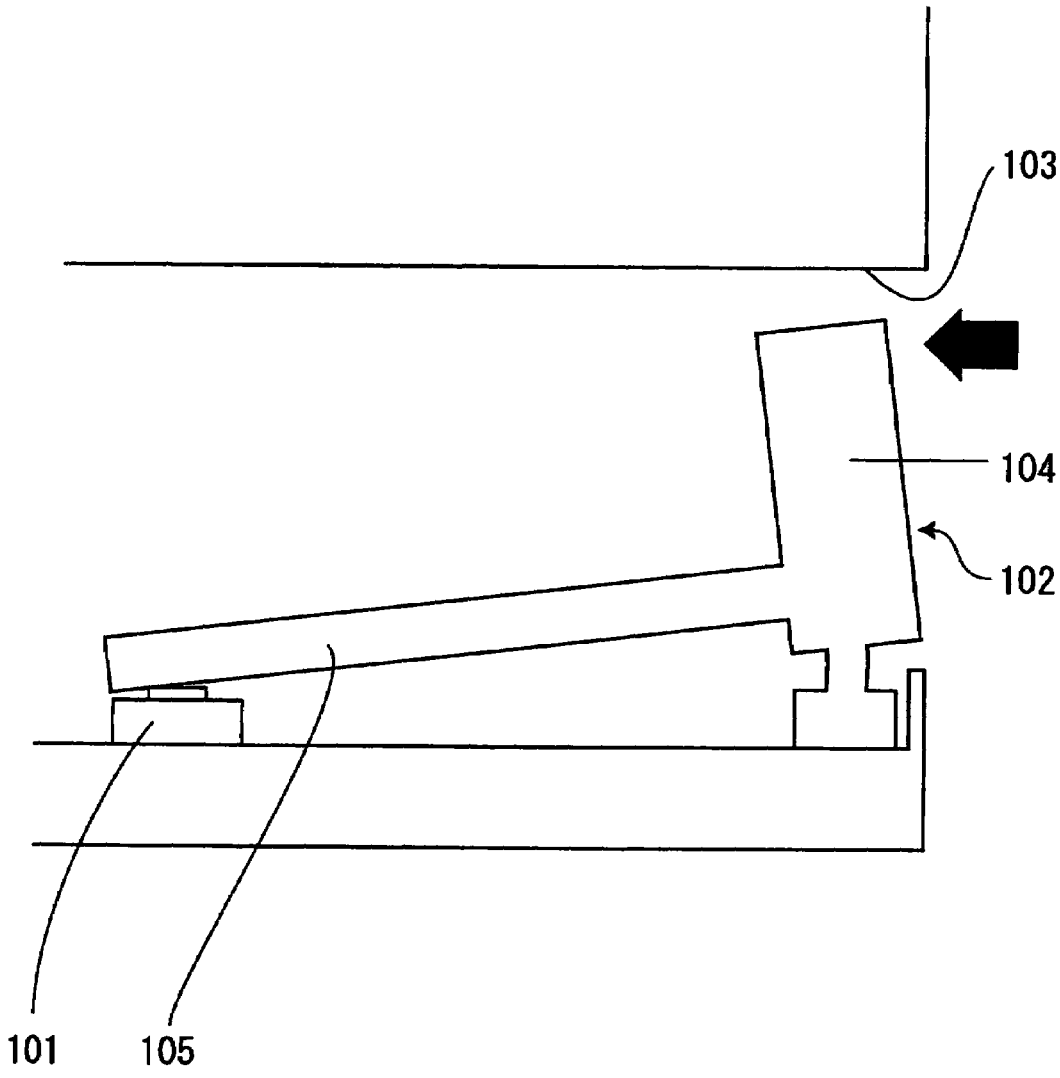
FIG. 15 is a side view showing the operated state of the manual operation plane according to the prior art.
Figure 16:
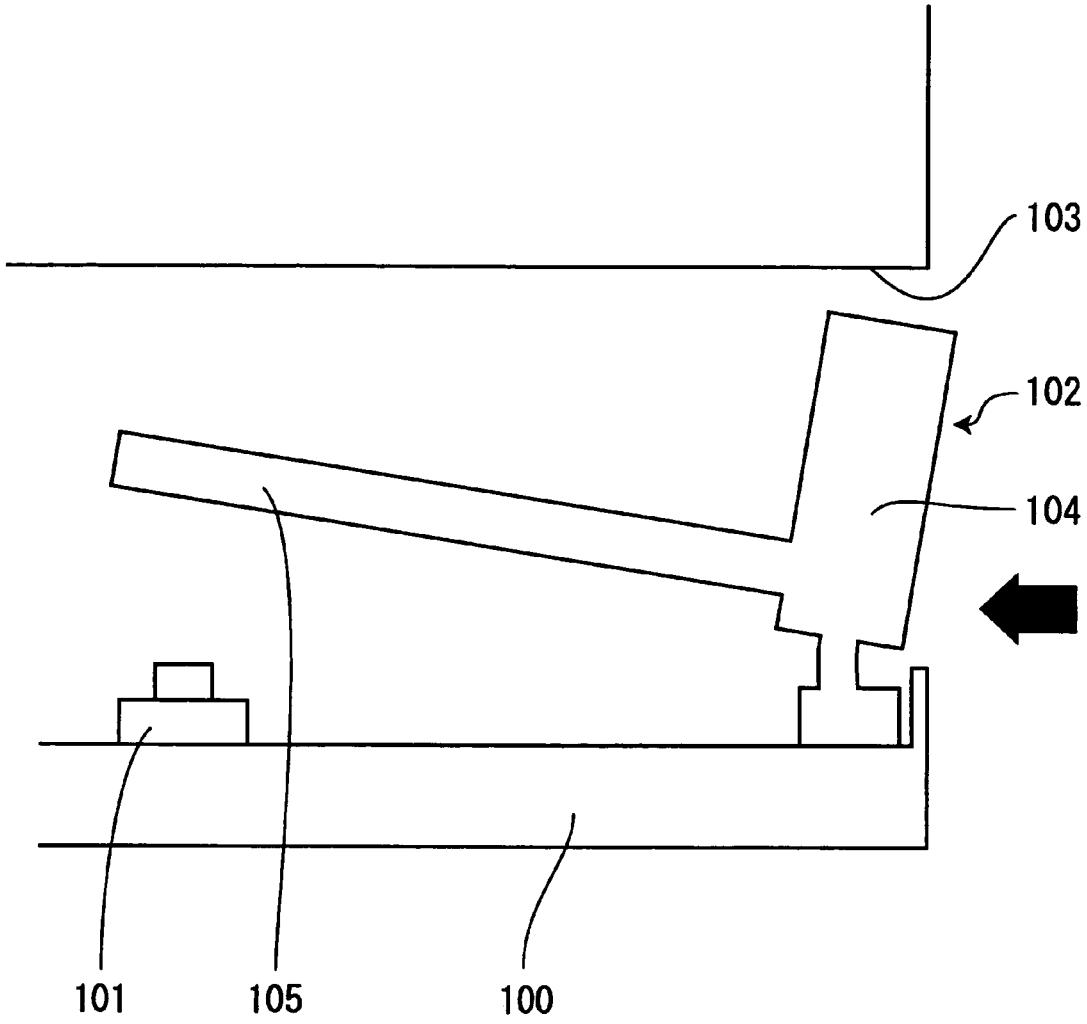
FIG. 16 is a side view showing the state in which the manual operation plane is protruded from the front face according to the prior art.

The preferred embodiment of the present invention has been described in detail up to now, but the present invention is not restricted to the embodiment illustrated above, and various modifications are enabled within the scope of the invention. For example, as illustrated in FIG. 12(*a*), the hinge portion 17 can be disposed on the upper area of the manual operation plane 11 so that by pressing the manual operation plane 11, the switch 6 disposed on the upper portion can be turned on and off. Further, as illustrated in FIG. 12(*b*), the hinge portion 17 can be formed near the center of the manual operation plane 11 so as to operate an upper switch 6*c* and a lower switch 6*d* by the manual operation plane 11. In this example, the upper switch 6*c* is operated by pressing the lower area of the manual operation plane 11 and the lower switch 6*d* is operated by pressing the upper area of the manual operation plane 11. Furthermore, as illustrated in FIG. 13, by disposing a protrusion-preventing stopper 31 composed of two components for preventing the manual operation button 10 from protruding from the front face of the casing 1 of the electronic device, it is possible to have the two parts of the protrusion-preventing stopper 31 contact each other to prevent the manual operation button 10 from protruding frontward when the lower area of the manual operation plane 11 is pressed.

The effects of the present invention are as follows.

The first aspect of the present invention relates to an electronic device with a manual operation button having a casing, a switch fixed to an inner side of the casing, and a manual operation button for operating the switch via the manual operation of a user, wherein the manual operation button comprises a manual operation plane exposed to an exterior through a mounting hole formed to the casing which is directly pressed by the user; a holder disposed at the rear portion of the manual operation plane and assembled to the manual operation plane; and a switch pressing portion extended rearward from the holder; and wherein the holder comprises a mounting portion used for mounting to the casing, and a hinge portion having a bendable thin wall connecting the holder and the mounting portion, the whole or a portion of the hinge portion disposed within an outer projection plane of the manual operation plane. According to this arrangement, it is possible to ensure a large manual operation plane and to increase the size of the operable region of the button. Moreover, by separately molding the manual operation plane requiring a high molding accuracy and the other parts requiring a lower molding accuracy than the manual operation plane, it is possible to reduce the molding costs of the manual operation button.

According to the second aspect of the present invention providing an electronic device with a manual operation button according to aspect 1, further comprising a stopper means capable of coming into contact with the manual operation button, no excessive force is applied to the switch fixed to the inner side of the casing even when the user presses the manual operation plane with excessive force.

According to the third aspect of the present invention providing an electronic device with a manual operation button according to aspects 1 or 2, further comprising a stopper means provided on the manual operation button that comes into contact with the casing to prevent the manual operation button from protruding from the casing, it is possible to prevent the manual operation button from protruding outward from the casing even when the manual operation plane is pressed in an extreme manner.

According to the fourth aspect of the present invention providing an electronic device with a manual operation button according to aspects 1, 2 or 3, wherein the hinge portion is disposed at an end portion of the outer projection plane of the manual operation plane, the operable region of the manual operation plane can be made larger since the hinge portion is disposed at an end of the outer projection plane of the manual operation plane.

The fifth aspect of the present invention provides a television receiver with a manual operation button comprising a casing, a substrate fixed to an inner side of the casing, a switch fixed to the substrate, and a manual operation button for operating the switch via manual operation of a user; wherein the casing includes a mounting hole through which a portion of the manual operation button is exposed to an exterior of the casing, a protruded portion for mounting the manual operation button, and a cover capable of being opened and closed by revolving around a spindle as a supporting point, having in the inner side of the cover a manual operation switch for adjusting volume and switching channels and a connecting terminal for connecting a cable for outputting/inputting signals to/from another electronic device; the manual operation button includes a manual operation plane exposed to the exterior of the casing to be pressed directly by the user, a holder disposed on a rear side of the manual operation plane, a switch pressing portion extended rearward from the holder, a mounting portion having a fitting hole that fits to the projection, and a hinge portion having a bendable thin wall connecting the holder and the mounting portion; wherein a whole area of the hinge portion is disposed within an outer projection plane of the manual operation plane, the hinge portion also having a stopper means disposed at a lower end portion of the outer projection plane and capable of coming into contact with the manual operation button; the holder, the switch pressing portion, the mounting portion and the hinge portion being formed integrally; the manual operation plane and the cover being disposed horizontally on a front face of the casing; and the height of the manual operation plane being substantially the same as that of the cover. According to this arrangement, it is possible to enlarge the operable region of the manual operation plane even further, and the button can be prevented from protruding outward from the casing. Moreover, the molding costs of the manual operation button can be suppressed, and the design of the television receiver can be improved further.

What is claimed is:

1. An electronic device with a manual operation button having a casing, a switch fixed to an inner side of the casing, and a manual operation button for operating the switch via the manual operation of a user, wherein the manual operation button comprises:

a manual operation plane exposed to an exterior through a mounting hole formed to the casing which is directly pressed by the user;

a holder disposed at the rear portion of the manual operation plane and assembled to the manual operation plane; and a switch pressing portion extended rearward from the holder;

wherein the holder comprises a mounting portion used for mounting to the casing, and a hinge portion having a bendable thin wall connecting the holder and the mounting portion, wherein the hinge portion is disposed at an end portion of an outer projection plane of the manual operation plane.

2. The electronic device with a manual operation button according to claim 1, further comprising a stopper means capable of coming into contact with the manual operation button.

3. The electronic device with a manual operation button according to claim 2, further comprising a stopper means provided on the manual operation button that comes into contact with the casing to prevent the manual operation button from protruding from the casing.

4. The electronic device with a manual operation button according to claim 1, further comprising a stopper means provided on the manual operation button that comes into contact with the casing to prevent the manual operation button from protruding from the casing.

5. A television receiver with a manual operation button comprising a casing, a substrate fixed to an inner side of the casing, a switch fixed to the substrate, and a manual operation button for operating the switch via manual operation of a user; wherein the casing includes a mounting hole through which a portion of the manual operation button is exposed to an exterior of the casing, a protruded portion for mounting the manual operation button, and a cover capable of being opened and closed by revolving around a spindle as a supporting point, having in the inner side of the cover a manual operation switch for adjusting volume and switching channels and a connecting terminal for connecting a cable for outputting/inputting signals to/from another electronic device;

the manual operation button includes a manual operation plane exposed to the exterior of the casing to be pressed directly by the user, a holder disposed on a rear side of the manual operation plane, a switch pressing portion extended rearward from the holder, a mounting portion having a fitting hole that fits to the projection, and a hinge portion having a bendable thin wall connecting the holder and the mounting portion; wherein a whole area of the hinge portion is disposed within an outer projection plane of the manual operation plane, the hinge portion also having a stopper means disposed at a lower end portion of the outer projection plane and capable of coming into contact with the manual operation button; the holder, the switch pressing portion, the mounting portion and the hinge portion being formed integrally; the manual operation plane and the cover being disposed horizontally on a front face of the casing; and the height of the manual operation plane being substantially the same as that of the cover.

* * * * *